US007210844B2

(12) United States Patent
Hiranuma et al.

(10) Patent No.: US 7,210,844 B2
(45) Date of Patent: May 1, 2007

(54) WRISTWATCH AND BAND TIMEPIECE

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/439,904

(22) Filed: May 24, 2006

(65) Prior Publication Data

US 2006/0280038 A1 Dec. 14, 2006

(30) Foreign Application Priority Data

Jun. 10, 2005 (JP) ..... 2005-170281

(51) Int. Cl.
*G04B 19/00* (2006.01)
*A44C 5/14* (2006.01)
*A45C 11/10* (2006.01)

(52) U.S. Cl. ..... 368/282; 224/177; 224/180

(58) Field of Classification Search ..... 368/281–282; 224/177, 180

See application file for complete search history.

(56) References Cited

U.S. PATENT DOCUMENTS 3,039,263 A * 6/1962 Wyler et al. ..... 368/282
5,398,218 A * 3/1995 Munnier et al. ..... 368/282
5,416,953 A * 5/1995 Hui ..... 24/265 WS
5,483,505 A * 1/1996 Cartier ..... 368/282
5,625,606 A * 4/1997 Openiano ..... 368/10

* cited by examiner

*Primary Examiner*—Vit W. Miska
(74) *Attorney, Agent, or Firm*—Adams & Wilks

(57) ABSTRACT

To provide a wristwatch in which a band can be easily attached to and detached from a case band without using an exclusive tool, in which a sufficient attachment strength with respect to the case band can be ensured, and moreover whose use feeling is good. Bow feet each of which has an attachment hole are protrusively provided in a case band, and a bow crotch receiving an end piece (case band connection end part) of a band capable of being attached to and detached from the case band so as to be capable of being put in and taken out is formed between the bow feet. An operation opening is provided in the end piece. A coupler having possessed a tubular rotation body and coupling axles is internally mounted in the end piece. The tubular rotation body has female screws, and the coupling axles are meshed with these female screws. The tubular rotation body is provided while facing on the operation opening, and manual-rotation-operated from an outside of the end piece. The coupling axles are locked to the end piece, and provided so as to be capable of being protruded and immersed with respect to an end face of the end piece in its width direction in accordance with the rotation of the tubular rotation body. The coupling axles having been protruded and immersed are inserted into and withdrawn from the attachment holes, so that an attachment/detachment of the band with respect to the case band is made possible.

12 Claims, 6 Drawing Sheets

WRISTWATCH AND BAND TIMEPIECE

BACKGROUND OF THE INVENTION

1. Field of the Invention

The present invention relates to a band for timepiece and a wristwatch in which this band has been detachably attached to a case band.

2. Description of the Prior Art

Hitherto, there is known a technique detachably attaching the band to the case band of the wristwatch without using an exclusive tool (for example, refer to Patent Document 1).

In this technique of the Patent Document 1, a metal plate having two curl parts is attached to an end part of a leather band, and a spring bar is provided while extending over the two curl parts. The spring bar has a handle being bent approximately like the V letter in an intermediate part of a spring wire material, and one end and the other end, which are bent so as to become mutually remote from this handle. Both ends of this spring bar are individually inserted into the two curl parts and rotatably held, and the handle is disposed between the two curl parts. And, in one of the two curl parts, there are provided a slant face causing the handle to slide widely and narrowly, and a taper face holding the handle in a narrow width end of this slant face under a contraction state.

The one end of the spring bar consisting of the spring wire material is always protruded from the curl part which holds the one end. In contrast to this, the other end of the spring bar is protruded from the other curl part by the fact that the handle widens following upon the fact that the handle is brought down to a back face of the band by being rotated, and is immersed into the other curl part by the fact that the handle becomes the contraction state following upon the fact that the handle is raised with respect to the back face of the band by being rotated reversely to the former.

Accordingly, by rotating the handle of the spring bar, the end of this spring bar can be put in and taken out of a hole provided in a bow foot of the case band. For this reason, the band can be attached to and detached from the case band without using the exclusive tool.

<Patent Document 1> Japanese Utility Model No. 3042321 Gazette

In a case where a spring property of the spring bar formed by bend-working the spring wire material, whose elastic deformation is possible, is strong, there decreases an operability when raising the handle of the spring bar. Reversely to this, in a case where the spring property of the spring bar is weak, there decreases a reliability for attaching and holding the band to the case band with a predetermined strength. The spring property of the spring bar is generally large in its dispersion because the bend working of the handle of the spring bar influences as well. For this reason, in ensuring both of an easy attachment/detachment operability of the band with respect to the case band and a sufficient attachment strength, the technique of the Patent Document 1 is not desirable.

Further, there is considered the fact that the handle of the spring bar existing along a back side of the band contacts with a user's wrist during use and, in this case, there is the fact that a use feeling is impaired.

Moreover, under a state that the band having been detached from the case band is kept in custody, it is normal that the handle of the spring bar is made into a state of extending along the back face of the band. For this reason, when attaching the band to the case band of the wristwatch, there becomes necessary a work for immersing the movable end of the spring bar into the curl part holding this end, by once raising the handle. Therefore, a work for attaching the band to the case band is comparatively troublesome as well.

SUMMARY OF THE INVENTION

An object of the present invention exists in providing a wristwatch in which the band can be easily attached to and detached from the case band without using the exclusive tool, in which a sufficient attachment strength with respect to the case band can be ensured, and moreover whose use feeling is good, and a band for timepiece, which is possessed in this wristwatch.

In order to solve the above problems, a wristwatch of the present invention comprises, in a wristwatch in which a band is detachably coupled to a case band, bow feet which are protruded from the case band while forming a bow crotch receiving a case band connection end part having an operation opening of the band so as to be capable of being put in and taken out, and each of which has an attachment hole, and a coupler internally mounted in the case band connection end part while possessing a coupling axle which is locked to the case band connection end part, which is provided so as to be capable of being protruded and immersed with respect to an end face of the case band connection end part in its width direction, and which is inserted into and withdrawn from the attachment hole by this protrusion/immersion, and a tubular rotation body which has a female screw with which the coupling axle is meshed, which is provided while facing the operation opening, and which is manual-rotation-operated from an outside of the case band connection end part.

In the wristwatch of this invention, in order to attach the band to the case band, after the case band connection end part of the band is disposed in the bow crotch of the case band, the coupling axle is protruded from the end face of the case band connection end part in its width direction by manually rotating the tubular rotation body of the coupler facing the operation opening of the case band connection end part without using the exclusive tool, a coin or the like. In this case, since the coupling axle is locked, the coupling axle is protruded from the case band connection end part in the width direction of this end part owing to the change of the state of the mesh between the coupling axle and the female screw, following upon a rotation of the tubular rotation body. By it, the coupling axle is inserted into the attachment hole of the bow foot, so that the band is attached to the case band.

In order to detach the band from the case band, the coupling axle is moved so as to be immersed into the end face of the case band connection end part in its width direction by manually rotating the tubular rotation body of the coupler facing the operation opening of the case band connection end part of the band disposed in the bow crotch of the case band without using the exclusive tool similarly to the case of the attachment. In this case, since the coupling axle is locked, the coupling axle can be retracted into the case band connection end part owing to the change of the state of the mesh between the coupling axle and the female screw, following upon the rotation of the tubular rotation body. By it, this coupling axle is withdrawn from the attachment hole, of the bow foot, to which it has been fitted till then, so that it is possible to remove the case band connection end part of the band from the bow crotch of the case band.

In this invention, since the coupling axle bearing the coupling of the band to the case band is not formed by a spring wire material, it can be formed by a material, such as metal, and with a thickness, which have a strength necessary for the coupling to the case band. By this, it is possible to ensure a sufficient attachment strength of the band with respect to the case band. And, a use feeling is good because the coupler is accommodated in the case band connection end part of the band and, even if an outer circumference of its tubular rotation body contacts with the user's wrist, no foreign body feeling is given.

In a preferable mode of a wristwatch of the present invention, the one pair of female screws are provided in the tubular rotation body while being made reverse screws, and the one pair of coupling axles are meshed individually with these female screws. In this case, the band is formed by coupling plural band pieces, and the case band connection end part can be formed by an end piece of this band, or the band is made of a leather or a synthetic leather, the operation opening is formed in one end part in which its leather member or synthetic leather member is folded back, and the case band connection end part can also be formed by building-in a coupling base member, to which the coupler is attached, in this one end part.

In the mode of this invention, by manually rotating the tubular rotation body, since the one pair of coupling axles can be simultaneously moved in mutually reverse directions to thereby be protruded and immersed with respect to the end face of the case band connection end part in its width direction, it is possible to more improve the attachment/detachment operability of the band with respect to the case band.

Further, in a preferable mode of a wristwatch of the present invention, the female screw and the coupling axle meshed with this female screw are provided in an axial direction one end side portion of the tubular rotation body and, in an axial direction other end portion of the tubular rotation body, there are provided the other coupling axle which is movable in a direction protruding and immersing with respect to the end face of the case band connection end part in its width direction, and which is inserted into and withdrawn from the attachment hole by that movement, and a biasing body which biases this the other coupling axle in a protrusion direction.

In the mode of this invention, in order to attach the band to the case band, first the case band connection end part of the band is disposed in the bow crotch of the case band. This disposition is performed by, after the other coupling axle biased by the biasing body has been inserted into one attachment hole by making the case band connection end part into a slant posture, accommodating the case band connection end part into the bow crotch and, under this state, moving the tubular rotation body in a direction of the one attachment hole while resisting against the biasing body. After this state, since the tubular rotation body is pushed back by the biasing body, the coupling axle of one meshing with the female screw can be inserted into the other attachment hole. After this, the tubular rotation body of the coupler facing the operation opening of the case band connection end part is manually rotated without using the exclusive tool, the coin or the like, thereby sufficiently protruding the coupling axle from the end face of the case band connection end part in its width direction. In this case, since the coupling axle is locked, the coupling axle is protruded from the case band connection end part in the width direction of this end part owing to the change of the state the mesh between the coupling axle and the female screw, following upon the rotation of the tubular rotation body, and it is deeply inserted into the attachment hole of the bow foot. By the above operations, the band is attached to the case band.

In order to detach the band from the case band, the coupling axle of one meshing with the female screw is moved in a direction immersed into the end face of the case band connection end part in its width direction by manually rotating the tubular rotation body of the coupler facing the operation opening of the case band connection end part of the band disposed in the bow crotch of the case band without using the exclusive tool similarly to the case of the attachment. In this case, since the coupling axle is locked, the coupling axle is moved toward an inside of the case band connection end part owing to the change of the state of the mesh between the coupling axle and the female screw, following upon the rotation of the tubular rotation body. And, it is possible to remove the case band connection end part from the bow crotch of the case band by withdrawing the coupling axle from the attachment hole, of the bow foot, to which it has been fitted till then by slanting the case band connection end part of the band while approaching it to a side of the other coupling axle biased by the biasing body.

In this invention, since the coupling axle bearing the coupling of the band to the case band is not formed by the spring wire material, it can be formed by the material, such as metal, and with the thickness, which have the strength necessary for the coupling to the case band. By this, it is possible to ensure the sufficient attachment strength of the band with respect to the case band. And, the use feeling is good because the coupler is accommodated in the case band connection end part of the band and, even if the outer circumference of its tubular rotation body contacts with the user's wrist, no foreign body feeling is given.

Further, in a preferable mode of a wristwatch of the present invention, the operation opening is exposed in a back face of the case band connection end part.

In the mode of this invention, since the tubular rotation body facing the operation opening is concealed at a use time of the wristwatch, an appearance at the use time is good, and there is no fear that the tubular rotation body is unguardedly rotated by the fact that other object contacts with this tubular rotation body at the use time.

Further, in order to solve the above problems, a band for timepiece of the present invention is a band for timepiece, which is possessed in a wristwatch in which bow feet, which form a bow crotch and each of which has an attachment hole, are provided in a case band, and which is detachably coupled to the case band, comprising a case band connection end part which has an operation opening and which is received in the bow crotch so as to be capable of being put in and taken out, and a coupler internally mounted in the case band connection end part while possessing a coupling axle which is locked to the case band connection end part, which is provided so as to be capable of being protruded and immersed with respect to an end face of the case band connection end part in its width direction, and which is inserted into and withdrawn from the attachment hole by this protrusion/immersion, and a tubular rotation body which has a female screw with which the coupling axle is meshed, which is provided while facing the operation opening, and which is manual-rotation-operated from an outside of the case band connection end part.

In order to attach the band for timepiece of this invention to the case band, after the case band connection end part of the band has been disposed in the bow crotch of the case band, the coupling axle is protruded from the end face of the case band connection end part in its width direction by manually rotating the tubular rotation body of the coupler facing the operation opening of the case band connection end part without using the exclusive tool, the coin or the like.

In this case, since the coupling axle is locked, the coupling axle is protruded from the case band connection end part in the width direction of this end part owing to the change of the state of the mesh between the coupling axle and the female screw, following upon the rotation of the tubular rotation body. By it, the coupling axle is inserted into the attachment hole of the bow foot, so that the band is attached to the case band.

In order to detach the band from the case band, the coupling axle is moved so as to be immersed into the end face of the case band connection end part in its width direction by manually rotating the tubular rotation body of the coupler facing the operation opening of the case band connection end part of the band disposed in the bow crotch of the case band without using the exclusive tool, similarly to the case of the attachment. In this case, since the coupling axle is locked, the coupling axle can be retracted into the case band connection end part owing to the change of the state of the mesh between the coupling axle and the female screw, following upon the rotation of the tubular rotation body. By it, this coupling axle is withdrawn from the attachment hole, of the bow foot, to which it has been fitted till then, so that it is possible to remove the case band connection end part of the band from the bow crotch of the case band.

In this invention, since the coupling axle bearing the coupling of the band to the case band is not formed by the spring wire material, it can be formed by the material, such as metal, and with the thickness, which have the strength necessary for the coupling to the case band. By this, it is possible to ensure the sufficient attachment strength of the band with respect to the case band. And, the use feeling is good because the coupler is accommodated in the case band connection end part of the band and, even if the outer circumference of its tubular rotation body contacts with the user's wrist, no foreign body feeling is given.

In a preferable mode of a band for timepiece of the present invention, the one pair of female screws are provided in the tubular rotation body while being made reverse screws, and the coupling axles are meshed individually with these female screws. In this case, the band is formed by coupling plural band pieces, and the case band connection end part can be formed by an end piece of this band, or the band is made of a leather or a synthetic leather, the operation opening is formed in one end part in which its leather member or synthetic leather member has been folded back, and the case band connection end part can also be formed by building-in the coupling base member, to which the coupler is attached, in this one end part.

In the mode of this invention, by manually rotating the tubular rotation body, since the one pair of coupling axles can be simultaneously moved in mutually reverse directions to thereby be protruded and immersed with respect to the end face of the case band connection end part in its width direction, it is possible to more improve the attachment/detachment operability of the band with respect to the case band.

Further, in a preferable mode of a band for timepiece of the present invention, the female screw and the coupling axle meshed with this female screw are provided in the axial direction one end side portion of the tubular rotation body and, in the axial direction other end portion of the tubular rotation body, there are provided the other coupling axle which is movable in the direction protruding and immersing with respect to the end face of the case band connection end part in its width direction, and which is inserted into and withdrawn from the attachment hole by that movement, and the biasing body which biases this the other coupling axle in the protrusion direction.

In the mode of this invention, in order to attach the band to the case band, first the case band connection end part of the band is disposed in the bow crotch of the case band. This disposition is performed by, after the other coupling axle biased by the biasing body has been inserted into one attachment hole by making the case band connection end part into the slant posture, accommodating the case band connection end part into the bow crotch and, under this state, moving the tubular rotation body in the direction of the one attachment hole while resisting against the biasing body. After this state, since the tubular rotation body is pushed back by the biasing body, the coupling axle of one meshing with the female screw can be inserted into the other attachment hole. After this, the tubular rotation body of the coupler facing on the operation opening of the case band connection end part is manually rotated without using the exclusive tool, the coin or the like, thereby sufficiently protruding the coupling axle from the end face of the case band connection end part in its width direction. In this case, since the coupling axle is locked, the coupling axle is protruded from the case band connection end part in the width direction of this end part owing to the change of the state of the mesh between the coupling axle and the female screw, following upon the rotation of the tubular rotation body, and it is deeply inserted into the attachment hole of the bow foot. By the above operations, the band is attached to the case band.

In order to detach the band from the case band, the coupling axle of one meshing with the female screw is moved in the direction immersed into the end face of the case band connection end part in its width direction by manually rotating the tubular rotation body of the coupler facing the operation opening of the case band connection end part of the band disposed in the bow crotch of the case band without using the exclusive tool similarly to the case of the attachment. In this case, since the coupling axle is locked, the coupling axle is moved toward the inside of the case band connection end part owing to the change of the state of the mesh between the coupling axle and the female screw, following upon the rotation of the tubular rotation body. And, it is possible to remove the case band connection end part from the bow crotch of the case band by withdrawing the coupling axle from the attachment hole, of the bow foot, to which it has been fitted till then by slanting the case band connection end part of the band while approaching it to the side of the other coupling axle biased by the biasing body.

In this invention, since the coupling axle bearing the coupling of the band to the case band is not formed by the spring wire material, it can be formed by the material, such as metal, and with the thickness, which have the strength necessary for the coupling to the case band. By this, it is possible to ensure the sufficient attachment strength of the band with respect to the case band. And, the use feeling is good because the coupler is accommodated in the case band connection end part of the band and, even if the outer circumference of its tubular rotation body contacts with the user's wrist, no foreign body feeling is given.

Further, in a preferable mode of a band for timepiece of the present invention, the operation opening is exposed in the back face of the case band connection end part.

In the mode of this invention, since the tubular rotation body facing on the operation opening is concealed at the use time of the wristwatch, the appearance at the use time is good, and there is no fear that the tubular rotation body is unguardedly rotated by the fact that other object contacts with this tubular rotation body at the use time.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A 1st embodiment of the present invention is explained by referring to FIG. 1 to FIG. 4.

Figure 1:
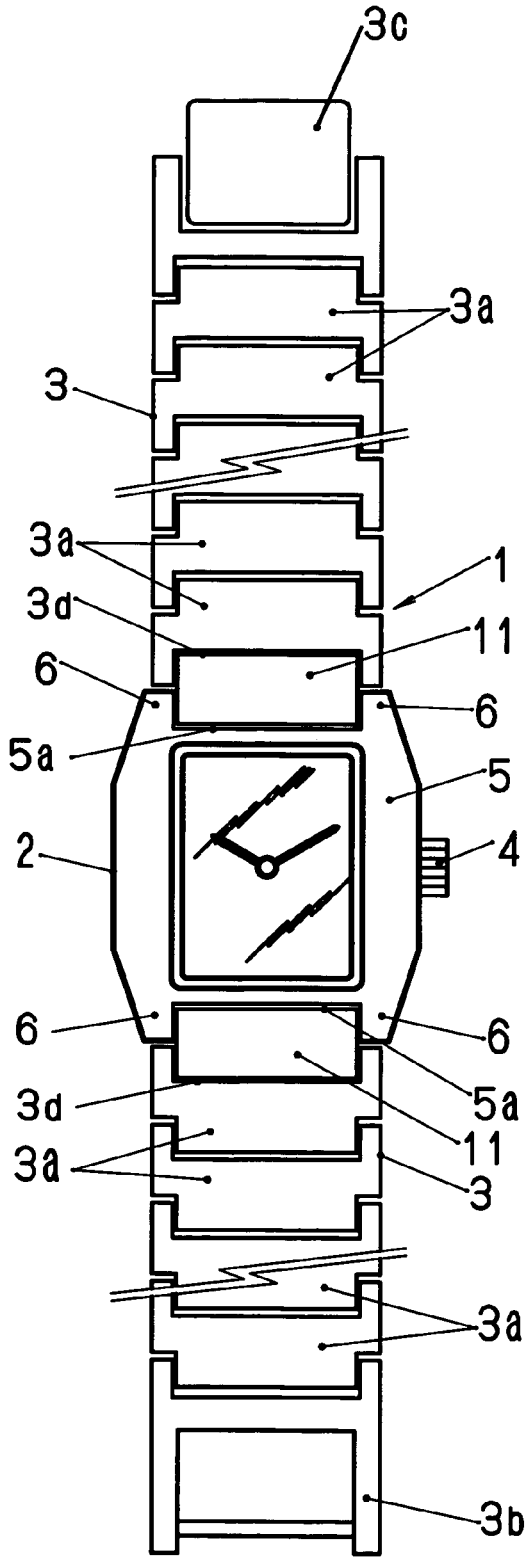
FIG. 1 is a plan view showing a wristwatch concerned with a 1st embodiment of the present invention.

In a wristwatch 1 shown in FIG. 1, one pair of bands 3 for instance are attached to a timepiece armor assembly 2. Within the timepiece armor assembly 2, there are accommodated a dial, a timepiece movement not shown in the drawing, and the like. Incidentally, in FIG. 1, a reference numeral 4 denotes a crown.

As shown in FIG. 1, the bands 3 are detachably attached to a case band 5, made of a metal or a synthetic resin, that the timepiece armor assembly 2 possesses, while corresponding to 6 o'clock and 12 o'clock sides of the dial. The band 3 is formed by rotatably coupling plural coupling band pieces 3*a* made of the metal or the synthetic resin by bar-like piece-coupling components (not shown in the drawing) with this piece-coupling component being made a center. A connection end part 3*b* that one band 3 has and a connection end part 3*c* that the other band 3 has are capable of engaging and disengaging and, by that engagement, a state that the bands 3 are wound around the user's wrist can be held.

Since constitutions for attaching and detaching the one pair of bands 3 to and from the case band 5 are the same, one of them is explained here while being represented.

As shown in FIG. 1 and FIG. 2, in an outer circumference face of the case band 5 of the timepiece armor assembly 2, one pair of bow feet (capable of being called bow parts as well) 6 are monolithically, protrusively provided while respectively corresponding to the 6 o'clock and 12 o'clock sides of the dial. A bow crotch 5*a* is formed between the bow feet 6 making the pair, while corresponding to a 3 o'clock–9 o'clock direction of the dial. As shown in FIG. 2, an attachment hole 7 is provided in each of the bow feet 6. The attachment hole 7 is respectively opened to the bow crotch 5*a*. The attachment hole 7 may be a through-hole or a bottomed concave part.

The band 3 possesses, in its end part located in a timepiece armor assembly 2 side, an end piece 11 functioning as a case band connection end part. It is desirable that this end piece 11 is made of the metal, but they may be made of a hard synthetic resin. A width of the end piece 11 is somewhat narrower than a width of a concave part 3*d* that the band piece 3*a* has, and somewhat narrower than the distance between the bow feet 6 making the pair while corresponding to the 3 o'clock–9 o'clock direction of the dial, in other words, a width of the bow crotch 5*a*.

Figure 2A:
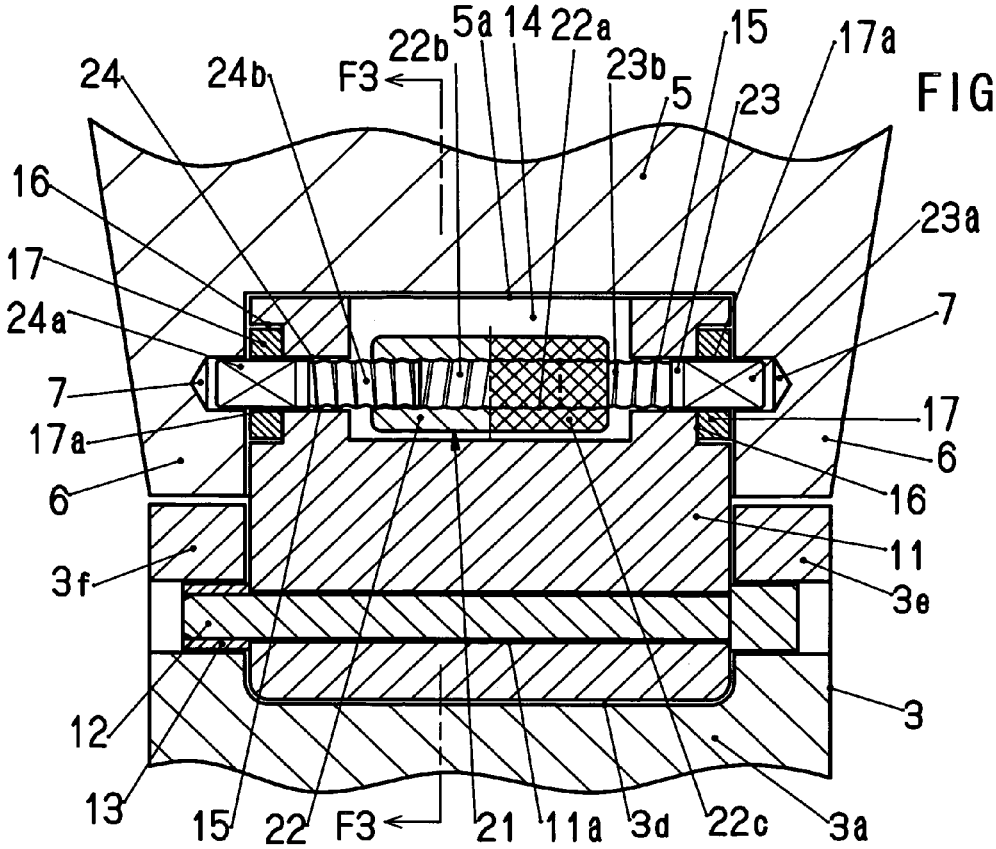
FIG. 2A is a sectional view showing, under a coupled state, a coupling part between a case band and a band.
Figure 2B:
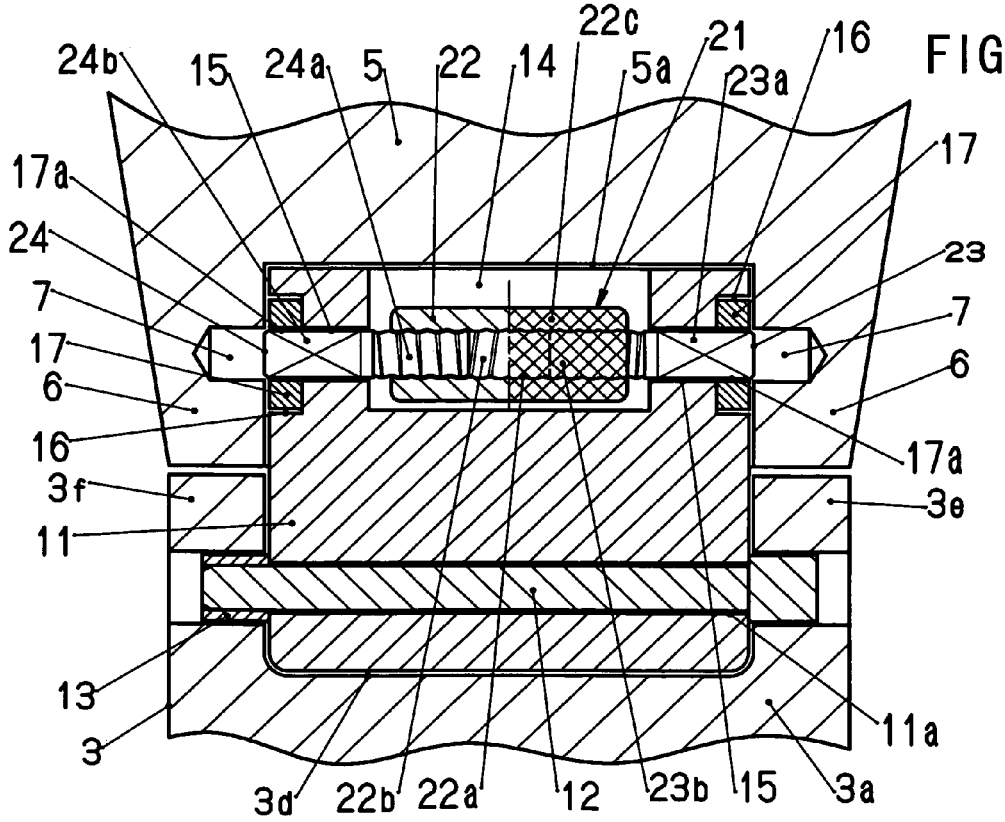
FIG. 2B is a sectional view showing, under a coupling-released state, the coupling part between the case band and the band.
Figure 3:
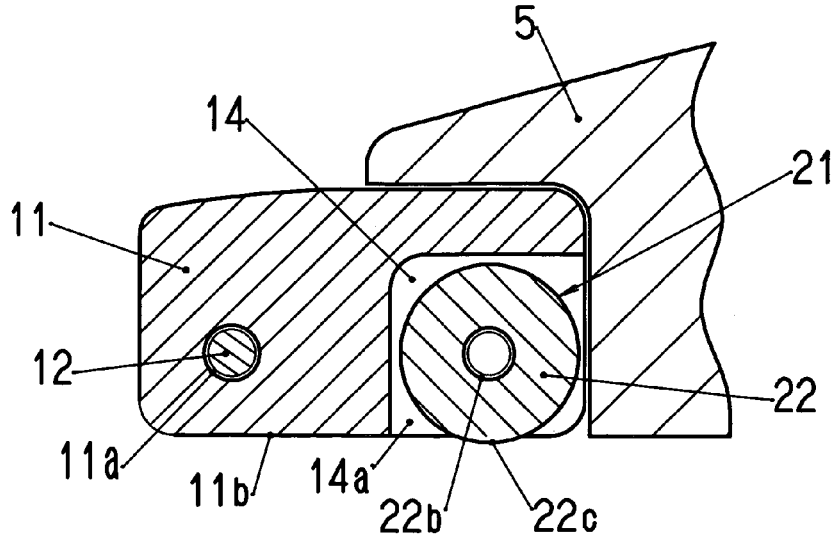
FIG. 3 is a sectional view of the coupling part, which shows along an F3—F3 line in FIG. 2A.
Figure 4:
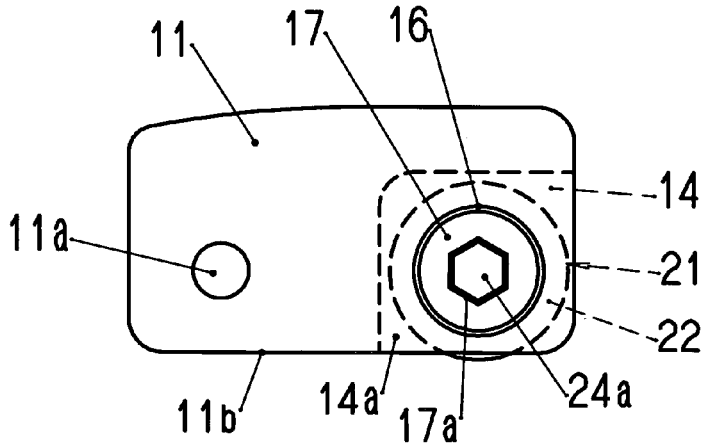
FIG. 4 is a side view showing a case band connection end part of the band that the wristwatch of FIG. 1 possesses.

As shown in FIG. 2 to FIG. 4, the end piece 11 has, in its portion fitted to the concave part 3*d* of the band piece 3*a* disposed most adjacently to the timepiece armor assembly 2, a though-hole 11*a* penetrating through the above portion in a width direction. The end piece 11 is fitted to the concave part 3*d*, and rotatably coupled to the band piece 3*a* by fitting, within a convex part 3*f* having partitioned a width direction other end of the concave part 3*d*, a slotted (not shown in the drawing) coupling pipe 13 to a tip part of a coupling pin 12 having been passed though the through-hole 11*a* from a convex part 3*e* having partitioned a width direction one end of the concave part 3*d*.

In a portion, of the end piece 11, protruded from the band piece 3*a* disposed most adjacently to the timepiece armor assembly 2, there are provided an accommodation part 14, one pair of holes 15 communicating with this accommodation part 14, and grooves 16 communicating with these holes 15 and having been opened to width direction both end faces of the end piece 11. The accommodation part 14 is opened to over the end faces and a back face 11*b* of the end piece 11 and, among them, a back face opening is used as an operation opening 14*a* (refer to FIG. 3). The hole 15 is a circular hole for instance. The groove 16 is also a circular shape for instance as shown in FIG. 4.

A lock plate 17 as a lock means is accommodated in each of the grooves 16, and fixed to the end piece 11 by a spot welding, a blazed joint or the like. In a center part of the lock plate 17, there is opened an angular hole, e.g., a hexagonal hole 17*a* as shown in FIG. 4, which faces the hole 15. This angular hole 17*a* is formed somewhat larger than a diameter of the circular hole 15.

In the portion, of the end piece 11, protruded from the band piece 3*a* disposed most adjacently to the timepiece armor assembly 2, there is internally mounted a coupler 21. The coupler 21 possesses a tubular rotation body 22, a 1st coupling axle 23, and a 2nd coupling axle 24.

The tubular rotation body 22 made of the metal or the hard synthetic resin makes desirably a cylindrical shape and has, in its inner circumference face, a 1st female screw 22*a* and a 2nd female screw 22*b*. The 1st female screw 22*a* and the 2nd female screw 22*b* are mutually reverse screws. An outer circumference face of this tubular rotation body 22 is formed by a knurled face 22*c*, to which a knurling working has been applied, as a non-slip means of a finger when manual-rotation-operating the tubular rotation body 22.

The 1st coupling axle 23 comprises a prism part 23*a* having the same shape as the angular hole 17*a*, and a screw axle part 23*b* monolithically continued to the former. This 1st coupling axle 23 is protrusively provided in one end of the tubular rotation body 22 with its screw axle part 23*b* being meshed with the 1st female screw 22*a* so as to be capable of moving backward and forward. Similarly, the 2nd coupling axle 24 also comprises a prism part 24*a* having the same shape as the angular hole 17*a*, and a screw axle part 24*b* monolithically continued to the former. This 2nd coupling axle 24 is protrusively provided in the other end of the tubular rotation body 22 with its screw axle part 24*b* being meshed with the 2nd female screw 22*b* so as to be capable of moving backward and forward.

The coupler 21 is attached to the end piece 11 under a both-end-supported state and with the tubular rotation body 22 being accommodated in the accommodation part 14 by inserting the 1st coupling axle 23 into one hole 15 and inserting the 2nd coupling axle 24 into the other hole 15. Under this attachment state, the prism part 23*a* of the 1st coupling axle 23 is inserted into one angular hole 17*a* and thereby locked and, similarly, the prism part 24*a* of the 2nd coupling axle 24 is inserted into the other angular hole 17*a* and thereby locked.

In order to make a rotation operation of the tubular rotation body 22 easier, as shown in FIG. 3, the knurled face 22*c* forming the outer circumference face of the tubular rotation body 22 is slightly protruded from the operation opening 14*a*. Incidentally, it is also possible to provide the tubular rotation body 22 such that its outer circumference face does not protrude from the back face 11*b* of the end piece 11. In this case, it is desirable in a point that there is no fear that the tubular rotation body 22 is unguardedly rotated following upon an attachment/detachment of the wristwatch 1 to/from the user's wrist, or the like.

There are explained procedures for coupling the band 3 to the case band 5 of the timepiece armor assembly 2 though the coupler 21 of the above constitution.

First, as shown in FIG. 2B, the end piece 11 of the band 3 is disposed in the bow crotch 5*a* of the timepiece armor assembly 2. In this case, by the fact that the detachment of the band 3 is performed by procedures mentioned later, the 1st coupling axle 23 and the 2nd coupling axle 24 exist under a most retracted state. Under this state, tips of the coupling axles 23, 24 become a state not protruding from the width direction both end faces of the end piece 11, in other words, they are retracted with respect to the width direction both end faces of the end piece 11, or become the same plane as the both end faces. In a point of time at which, following upon above disposition, a tip face of the end piece 11 has become so as to impinge against an interior face of the bow crotch 5*a*, the one pair of coupling axles 23, 24 are respectively positioned to the corresponding attachment holes 7. Next, the tubular rotation body 22 exposed in the operation opening 14*a* in a back side of the wristwatch 1 is rotated in one direction by a worker's finger. A rotation direction in this case is caused to be previously known by an owner's manual or the like.

The 1st coupling axle 23 and the 2nd coupling axle 24 are locked respectively by the left and right lock plates 17. For this reason, following upon the tubular rotation body 22 is rotated, the 1st coupling axle 23 moves in a right direction from a state of FIG. 2B by a change in a mesh state between its screw axle part 23*b* and the 1st female screw 22*a*, and is protruded from a right end face of the end piece 11. Similarly, following upon above rotation of the tubular rotation body 22, the 2nd coupling axle 24 moves in a left direction from the state of FIG. 2B by the change in the mesh state between its screw axle part 24*b* and the 2nd female screw 22*b*, and is protruded from a left end face of the end piece 11.

By the fact that the 1st coupling axle 23 and the 2nd coupling axle 24 are simultaneously moved in the directions mutually separating like this, as shown in FIG. 2A, the prism part 23*a* of the 1st attachment axle 23 is inserted into the attachment hole 7 of the bow foot 6 in a right side in this drawing, and the prism part 24*a* of the 2nd attachment axle 24 is inserted into the attachment hole 7 of the bow foot 6 in a left side, so that the band 3 is attached to the case band 5.

At the use time of the wristwatch 1, since the operation opening 14*a* is covered by the user's wrist, the tubular rotation body 22 is not confirmed visually and this is desirable in an external appearance, and there is no fear that the tubular rotation body 22 is rotated by the fact that an article unguardedly impinges against this tubular rotation body 22 from the front side of the wristwatch 1.

In an exchange of the band 3 or the like, in order to detach the band 3 from the case band 5, the tubular rotation body 22 exposed in the operation opening 14*a* in the back side of the wristwatch 1 is rotated by the worker's finger in a direction reverse to the rotation direction on the occasion of the band attachment. The rotation direction in this case is caused to be previously known by the owner's manual or the like.

Following upon the reverse rotation of the tubular rotation body 22, the 1st coupling axle 23 is moved, by a change in the mesh state between its screw axle part 23*b* and the 1st female screw 22*a*, from a state of FIG. 2A to a left direction so as not to protrude from a right end face of the end piece 11. At the same time, following upon the above reverse rotation of the tubular rotation body 22, the 2nd coupling axle 24 is moved, by a change in the mesh state between its screw axle part 24*b* and the 2nd female screw 22*b*, from the state of FIG. 2A to a right direction so as not to protrude from a left end face of the end piece 11.

By these, since the 1st coupling axle 23 or the 2nd coupling axle 24 is retracted from the right or left attachment hole 7 corresponding to each of them and becomes a state of FIG. 2B, it is possible to detach the band 3 from the case band 5 by thereafter withdrawing the end piece 11 from the bow crotch 5*a*.

As having been explained above, it is possible to attach and detach the band 3 to and from the case band 5 by the fact that, by such a simple operation that the tubular rotation body 22 of the coupler 21 incorporated into the band 3 is rotated by a manual rotation operation without using the exclusive tool, the coin or the like, theist coupling axle 23 and the 2nd coupling axle 24 are protruded and immersed with respect to the width direction both ends of the end piece 11 to thereby insert and withdraw them into and from the attachment holes 7 of the bow feet 6.

Accordingly, as to the wristwatch 1 of the above constitution, its assembly workability is good and, also in the user, it is possible to easily attach and detach the band 3 to and from the case band 5. By this, in a case where the user previously prepares plural bands 3 in each of which the coupler 21 is internally mounted in the case band connection end part of the end piece 11 or the like and whose designs are different, it becomes possible to use the wristwatch 1 while giving a change in design to it by easily, suitably exchanging to the desired band 3 by the procedures having been already mentioned.

Additionally, as already mentioned, since the coupling axles 23, 24 bearing the coupling of the band 3 to the case band 5 are not formed by the spring wire material, they can be formed by the material, such as metal, and with the thickness, which have the strength necessary for the coupling to the case band 5. By this, it is possible to ensure the sufficient attachment strength of the band 3 with respect to the case band 5. And, the use feeling is good because the coupler 21 is accommodated in the end piece 11 that is the case band connection end part of the band 3 and, even if the circular outer circumference of its tubular rotation body 22 contacts with the user's wrist, no foreign body feeling is given.

Incidentally, in the 1st embodiment, in order to lock the 1st coupling axle 23 and the 2nd coupling axle 24, there is provided the lock plate 17. However, instead of omitting this lock plate, there may be adapted such that the holes 15 are formed by the angular holes and to thereby be used as lock means, and the prism part 23*a* of the 1st coupling axle 23 and the prism part 24*a* of the 2nd coupling axle 24 are inserted into these angular holes so as to be capable of sliding in an axial direction.

Further, besides this, there may be adapted such that the lock plate 17 is formed by a portion fixed to the end piece 11 and a small protrusion facing on the circular hole 15, the prism part corresponding portions of the coupling axles 23, 24 are made round bars and long grooves extending in a longitudinal direction are formed in their circumference faces, and the coupling axles 23, 24 are locked while allowing movements of these coupling axles 23, 24 along the axial direction by fitting this long groove to the small protrusion so as to be capable of sliding.

Figure 5:
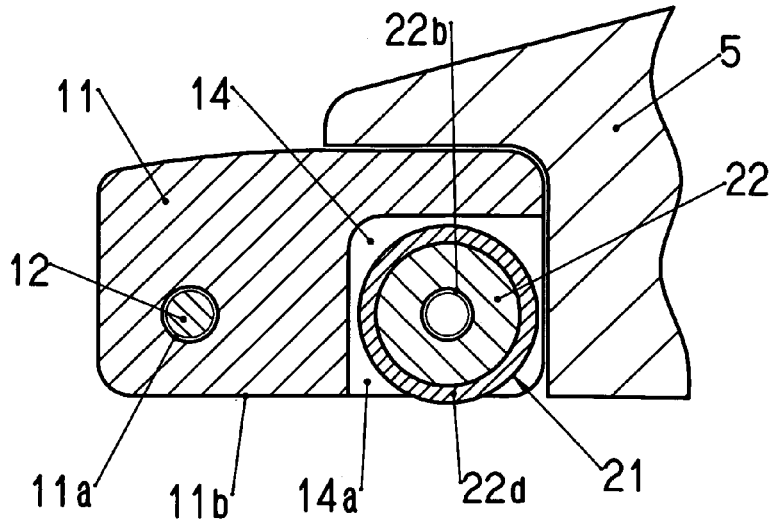
FIG. 5 is a sectional view corresponding to FIG. 3, which shows a coupling part between a case band and a band of a wristwatch concerned with a 2nd embodiment of the present invention.

FIG. 5 shows a 2nd embodiment of the present invention. Except matters explained below, since the 2nd embodiment is the same constitution as the 1st embodiment with constitutions not shown in FIG. 5 being included, the same reference numeral as the 1st embodiment is applied as to the same constitution and its explanation is omitted.

In the 2nd embodiment, the tubular rotation body 22 of the coupler 21 has a friction layer 22*d* forming its outer circumference face. The friction layer 22*d* is made of a friction material such as synthetic rubber and elastomer. By this friction layer 22*d*, when rotation-operating the tubular rotation body 22, the finger is more suppressed from slipping. Additionally, it is desirable in a point that the tubular rotation body 22 made of the metal or the like can be prevented from contacting with a sweat of the user.

In this 2nd embodiment, since the band is attached to and detached from the case band 5 through the coupler 21 having been internally mounted in the end piece 11 of the band, the same action as the 1st embodiment is obtained, and the problem of the present invention can be solved.

Figure 6:
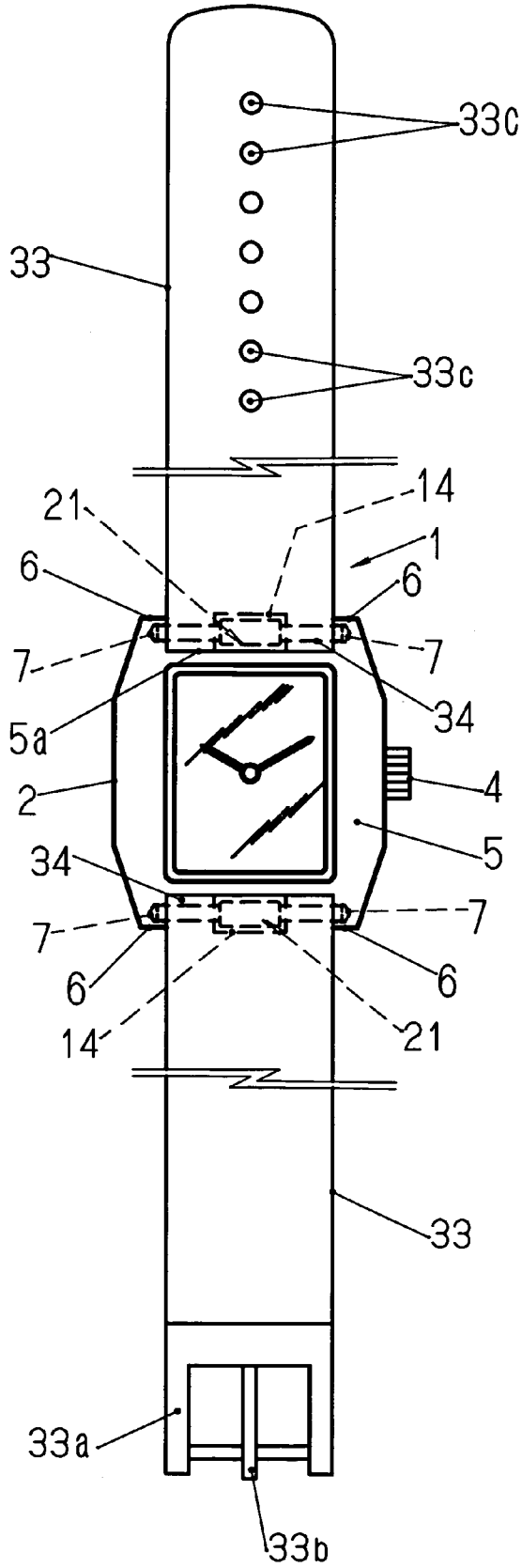
FIG. 6 is a plan view showing a wristwatch concerned with a 3rd embodiment of the present invention.
Figure 7:
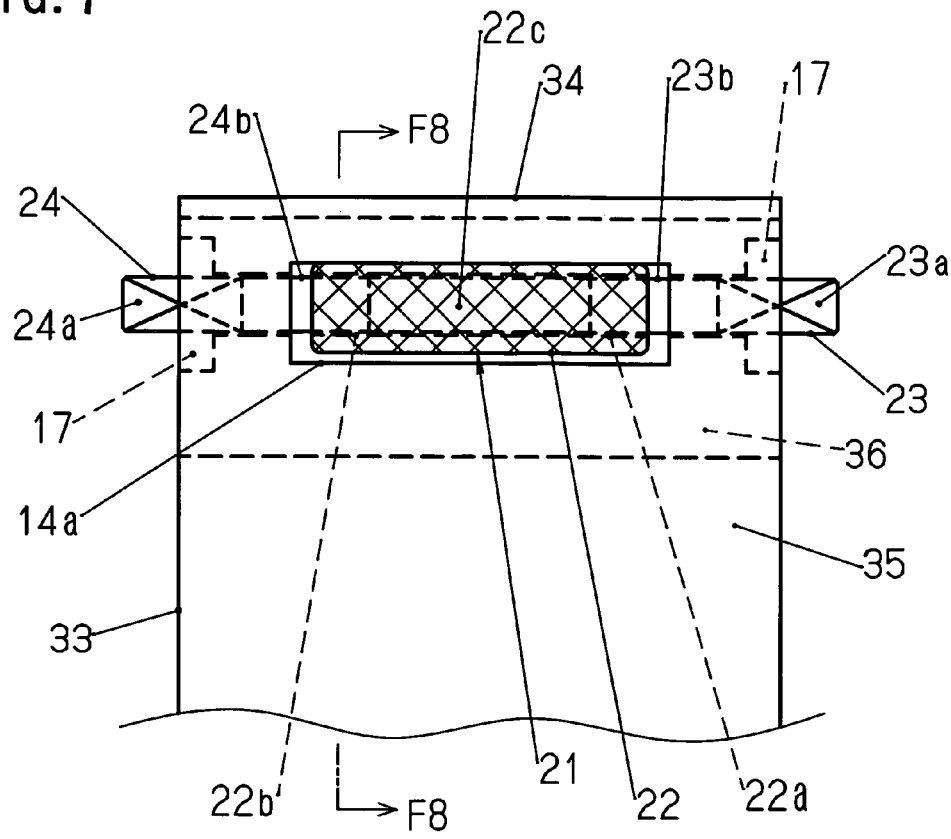
FIG. 7 is a back face view showing a case band connection end part of a band that the wristwatch of FIG. 6 possesses.
Figure 8:
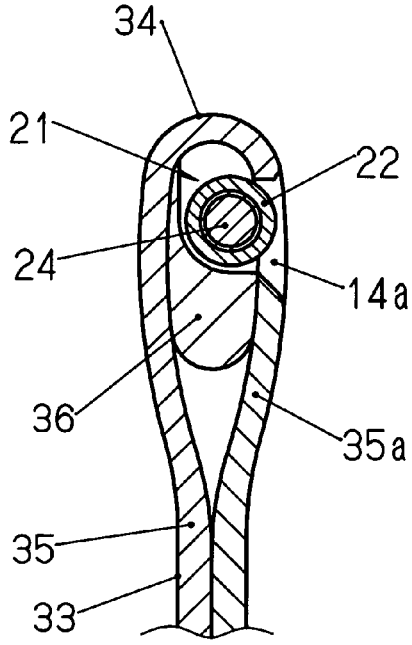
FIG. 8 is a sectional view of the case band connection end part, which shows along an F8—F8 line in FIG. 7.

FIG. 6 to FIG. 8 show a 3rd embodiment of the present invention. Except matters explained below, since the 3rd embodiment is the same constitution as the 1st embodiment with constitutions not shown in FIG. 6 to 8 being included, the same reference numeral as the 1st embodiment is applied as to the same constitution and its explanation is omitted.

In the 3rd embodiment, there is used a leather type band 33 which is formed with its main body being made of a synthetic leather, a leather or the like. As shown in FIG. 6, one band 33 has a buckle 33*a* and, in the other band 33, there are opened plural punch holes 33*c* into which a tongue 33*b* of the buckle 33*a* is selectively inserted.

As shown in FIG. 7 and FIG. 8, a case band connection end part 34 of the band 33 is formed while building-in a coupling base member 36 in a folded-back one end part of a leather member (or synthetic leather member) 35 forming the band 33. A reference numeral 35*a* in FIGS. 7 and 8 denotes a folded-back portion having been folded back so as to be overlapped to a back side of the leather member (or synthetic leather member) 35, and the operation opening 14*a* is opened in this folded-back portion 35*a*.

The coupling base member 36 is bonded into the folded-back end part by using an adhesive or the like. The coupling base member 36 is one corresponding to the end piece having been explained in the 1st embodiment, and the coupler 21 is attached to this coupling base member 36. The tubular rotation body 22 of the coupler 21 faces the operation opening 14*a* so as to be manual-rotation-operated through this operation opening 14*a*.

Except the points having been explained above, it is the same constitution as the 1st embodiment. Accordingly, also in the 3rd embodiment, since the band 33 can be attached to and detached from the case band 5 by rotating the tubular rotation body 22 of the coupler 21 having been internally mounted in the end piece 11 of the band 33 by the manual rotation, this 3rd embodiment obtains the same action as the 1st embodiment, and can solve the problem of the present invention.

Figure 9:
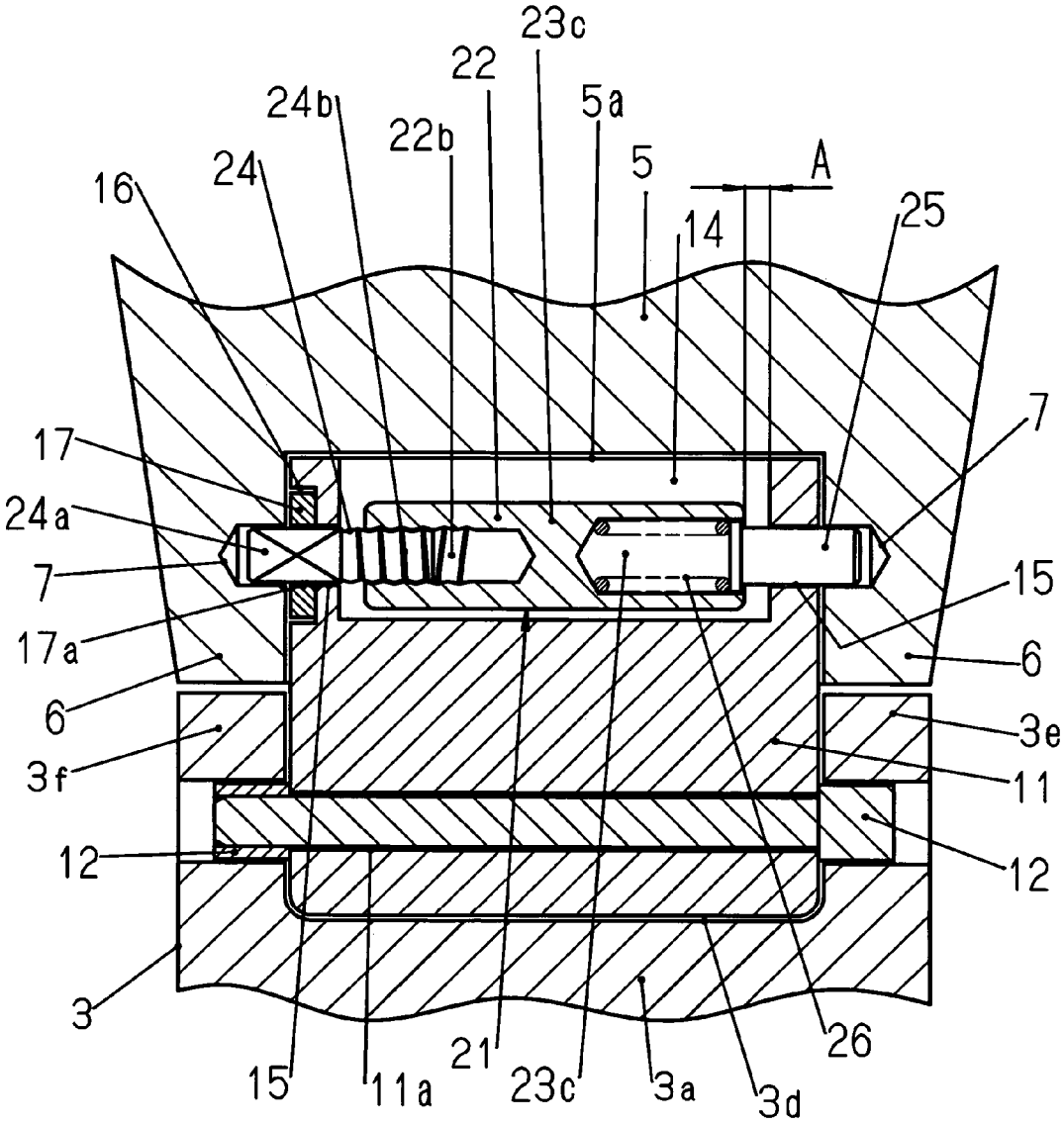
FIG. 9 is a sectional view corresponding to FIG. 2A, which shows, under a coupled state, a coupling part between a case band and a band of a wristwatch concerned with a 4th embodiment of the present invention.

FIG. 9 shows a 4th embodiment of the present invention. Except matters explained below, since the 4th embodiment is the same constitution as the 1st embodiment with constitutions not shown in FIG. 9 being included, the same reference numeral as the 1st embodiment is applied as to the same constitution and its explanation is omitted.

The tubular rotation body 22 of the coupler 21 used in the 4th embodiment has, in its longitudinal direction center part, a partition wall 23*c* and, with this partition wall 23*c* being made a boundary, there is provided an accommodation part 23*d* in one end side portion, and the female screw 22*b* is provided in the other end side portion.

An opening edge of the accommodation part 23*d* is somewhat curved so as to narrow this opening. A 1st coupling axle 25 is inserted into the accommodation part 23*d* so as not to be withdrawn from the accommodation part 23*d* by being caught by this opening edge. Additionally, in the accommodation part 23*a*, there is accommodated, e.g., a coil spring 26 as a biasing body. The 1st coupling axle 25 protrudes from one end of the tubular rotation body 22 and is passed through the hole 15 provided in one end of the end piece 11 forming the case band connection end part. The coil spring 26 is nipped between the 1st coupling axle 25 and the partition wall 23*c* under a compressed state, and biases the 1st coupling axle 25 in a direction protruding from an end face of the end piece 11. Except the points having been explained above, it is the same constitution as the 1st embodiment.

In order to attach the band 3 to the case band 5 in this 4th embodiment, first after making the end piece 11 into a state under which the 2nd coupling axle 24 has been slightly protruded from the one end face of the end piece 11, the 1st coupling axle 25 is inserted into the attachment hole 7 of one bow foot 6 while being made a slant posture in which one having the 2nd connection axle 24 becomes an upper side.

After this, the end piece 11 is accommodated in the bow crotch 5*a* by making the end piece 11 into a horizontal state posture while pushing the tubular rotation body 22 along its axial direction to thereby be moved while resisting against the coil spring 26 so as to vanish a dimension A shown in FIG. 9. After this accommodation, a push with respect to the end piece 11 in its axial direction is released. By this, since the tubular rotation body 22 is pushed back by a force of the coil spring 26, the prism part 24*a* of the 2nd coupling axle 24 is inserted into the attachment hole 7 of the other bow foot 6.

Finally, by rotating the tubular rotation body 22 under this state, an insertion of the 2nd coupling axle 24 with respect to the attachment hole 7 of the other bow foot 6 is deepened.

By this, it is possible to attach the band 3 to the case band 5. In this case, by the fact that a tip part of the prism part 24*a* of the 2nd coupling axle 24 is previously inserted into the attachment hole 7 as already mentioned, since it is possible to manual-rotation-operate the tubular rotation body 22 under a state that the coupler 21 has been both-end-supported by the end piece 11, there is no fear that the 2nd coupling axle 24 moved by this operation is caught by an edge part of the attachment hole 7 on which it faces, so that this is desirable in a point that the manual rotation operation can be smoothly performed.

Further, in order to detach the band 3 from the case band 5, first after the 2nd coupling axle 24 has been approached to the partition wall 23*c* by rotating the tubular rotation body 22 in a direction reverse to the procedures at the above attachment time, the tubular rotation body 22 is moved while resisting against the coil spring 26 so as to vanish the above dimension A. Next, under this state, the end piece 11 is slanted so as to become the slant posture in which one having the 2nd connection axle 24 becomes the upper side, and the end piece 11 is removed from the bow crotch 5*a* while withdrawing, from the attachment hole 7 of the one bow foot 6, the 1st coupling axle 25 inserted into this hole.

By this, it is possible to detach the band 3 from the case band 5. In this case, since the tubular rotation body 22 is moved by the above dimension A, even if a quantity of the rotation, of the tubular rotation body 22, performed till then is small, it is possible to detach the band 3 by certainly withdrawing the 2nd coupling axle 24 from the attachment hole 7 into which it has been inserted, and this is desirable in a point that it is possible to reduce the quantity of the rotation, of the tubular rotation body 22, by the manual rotation.

Also in the 4th embodiment having been explained above, since the band 3 can be attached to and detached from the case band 5 by rotating the tubular rotation body 22 of the coupler 21 having been internally mounted in the end piece 11 of the band 3 by the manual rotation, this 4th embodiment obtains the action similar to the 1st embodiment, and can solve the problem of the present invention.

According to the present invention, it is possible to provide a wristwatch in which the band can be attached to and detached from the case band by such an easy work that the tubular rotation body of the coupler is rotated by the mere manual rotation operation without using the exclusive tool, the coin or the like, in which the sufficient attachment strength with respect to the case band can be ensured by the one pair of coupling axles, and moreover whose use feeling is good, and a band for timepiece, which is used in this wristwatch.

What is claimed is:

1. A wristwatch in which a band is detachably coupled to a case band, comprising:

bow feet which are protruded from the case band while forming a bow crotch receiving a case band connection end part having an operation opening of the band so as to be capable of being put in and taken out, and each of which has an attachment hole, and a coupler having been internally mounted in the case band connection end part while possessing a coupling axle which is locked to the case band connection end part, which is provided so as to be capable of being protruded and immersed with respect to an end face of the case band connection end part in its width direction, and which is inserted into and withdrawn from the attachment hole by this protrusion/immersion, and a tubular rotation body which has a female screw with which the coupling axle is meshed, which is provided while facing on the operation opening, and which is manual-rotation-operated from an outside of the case band connection end part.

2. A wristwatch according to claim 1, wherein one pair of female screws are provided in the tubular rotation body while being made reverse screws, and one pair of coupling axles are meshed individually with these female screws.

3. A wristwatch according to claim 2, wherein the band is formed by coupling plural band pieces, and the case band connection end part is formed by an end piece of this band.

4. A wristwatch according to claim 2, wherein the band is made of a leather or a synthetic leather, the operation opening is formed in one end part in which its leather member or synthetic leather member is folded back, and the case band connection end part is formed by building-in a coupling base member, to which the coupler is attached, in this one end part.

5. A wristwatch according to claim 1, wherein the female screw and the coupling axle meshed with this female screw are provided in an axial direction one end side portion of the tubular rotation body and, in an axial direction other end portion of the tubular rotation body, there is provided another coupling axle which is movable in a direction protruding and immersing with respect to the end face of the case band connection end part in its width direction, and which is inserted into and withdrawn from the attachment hole by that movement, and a biasing body which biases this other coupling axle in a protrusion direction.

6. A wristwatch according to claim 1, wherein the operation opening is exposed in a back face of the case band connection end part.

7. A band for timepiece, which is possessed in a wristwatch in which bow feet, which form a bow crotch and each of which has an attachment hole, are provided in a case band, and which is detachably coupled to the case band, comprising:

a case band connection end part which has an operation opening and which is received in the bow crotch so as to be capable of being put in and taken out, and a coupler internally mounted in the case band connection end part while possessing a coupling axle which is locked to the case band connection end part, which is provided so as to be capable of being protruded and immersed with respect to an end face of the case band connection end part in its width direction, and which is inserted into and withdrawn from the attachment hole by this protrusion/immersion, and a tubular rotation body which has a female screw with which the coupling axle is meshed, which is provided while facing the operation opening, and which is manual-rotation-operated from an outside of the case band connection end part.

8. A band for timepiece according to claim 7, wherein one pair of female screws are provided in the tubular rotation body while being made reverse screws, and one pair of coupling axles are meshed individually with these female screws.

9. A band for timepiece according to claim 8, wherein the band is formed by coupling plural band pieces, and the case band connection end part is formed by an end piece of this band.

10. A band for timepiece according to claim 8, wherein the band is made of a leather or a synthetic leather, the operation opening is formed in one end part in which its leather member or synthetic leather member is folded back, and the case band connection end part is formed by building-in a coupling base member, to which the coupler is attached, in this one end part.

11. A band for timepiece according to claim 7, wherein the female screw and the coupling axle meshed with this female screw are provided in an axial direction one end side portion of the tubular rotation body and, in an axial direction other end portion of the tubular rotation body, there is provided another coupling axle which is movable in a direction protruding and immersing with respect to the end face of the case band connection end part in its width direction, and which is inserted into and withdrawn from the attachment hole by that movement, and a biasing body which biases this other coupling axle in a protrusion direction.

12. A band for timepiece according to claim 7, wherein the operation opening has been exposed in a back face of the case band connection end part.

* * * * *